US010507342B2

(12) United States Patent
Delerue et al.

(10) Patent No.: US 10,507,342 B2
(45) Date of Patent: Dec. 17, 2019

(54) FIRE-FIGHT VENTILATOR WITH OVALISED AIR JET

(71) Applicant: GROUPE LEADER, Octeville sur Mer (FR)

(72) Inventors: Thierry Delerue, Fontaine la Mallet (FR); Michael Steen, Montvillires (FR); Matthieu Bertauld, Genneville (FR)

(73) Assignee: GROUPE LEADER (FR)

( * ) Notice: Subject to any disclaimer, the term of this patent is extended or adjusted under 35 U.S.C. 154(b) by 76 days.

(21) Appl. No.: 15/556,480

(22) PCT Filed: Mar. 9, 2016

(86) PCT No.: PCT/FR2016/050535
§ 371 (c)(1),
(2) Date: Sep. 7, 2017

(87) PCT Pub. No.: WO2016/142624
PCT Pub. Date: Sep. 15, 2016

(65) Prior Publication Data

US 2018/0043193 A1 Feb. 15, 2018

(30) Foreign Application Priority Data

Mar. 12, 2015 (FR) ..... 15 52041

(51) Int. Cl.
*A62C 3/02* (2006.01)
*F04D 19/00* (2006.01)
(Continued)

(52) U.S. Cl.
CPC ..... *A62C 3/0207* (2013.01); *F04D 19/002* (2013.01); *F04D 29/542* (2013.01); *F04D 29/522* (2013.01); *F04D 29/563* (2013.01)

(58) Field of Classification Search
CPC ... A62C 3/0207; F04D 19/002; F04D 19/007; F04D 29/542; F04D 29/522; F04D 29/544; F04D 29/563
(Continued)

(56) References Cited

U.S. PATENT DOCUMENTS 3,128,036 A * 4/1964 McBride ..... A62C 3/0207 169/52
5,205,711 A * 4/1993 Raczykowski ..... A62C 3/0207 169/52
(Continued)

FOREIGN PATENT DOCUMENTS

DE 10 2011 013015 A1 9/2012
FR 2 890 569 A1 3/2007
WO 94/28976 A1 12/1994

OTHER PUBLICATIONS

Examination Report issued by IP India dated Aug. 23, 2019 from corresponding Indian Patent Application No. 201717031612, 5 pages.

*Primary Examiner* — Chee-Chong Lee
*Assistant Examiner* — Joseph A Greenlund
(74) *Attorney, Agent, or Firm* — Ware, Fressola, Maguire & Barber LLP

(57) ABSTRACT

A fire fighting blower (1) comprises a propeller (2) coaxially mounted in a tubular casing (3) for generating an axial airflow. The blower comprises an airflow guiding device (9) in the casing (3) for obtaining a concentrated air jet having a substantially ovalized section, it comprises within the tubular casing (3) an assembly of first deflectors (4) for concentrating the axial airflow and generating a concentrated axial air jet and an assembly of second deflectors (16, 17) for generating an air stream deflected from the concentrated axial air jet so that the concentrated air jet having an
(Continued)

ovalized section is a combination of the concentrated axial air jet and the deflected air stream.

14 Claims, 4 Drawing Sheets

(51) Int. Cl.
*F04D 29/54* (2006.01)
*F04D 29/52* (2006.01)
*F04D 29/56* (2006.01)

(58) Field of Classification Search
USPC ..... 169/91
See application file for complete search history.

(56) References Cited

U.S. PATENT DOCUMENTS 5,393,197 A * 2/1995 Lemont ..... F04D 25/12 415/211.1
6,244,818 B1 * 6/2001 Chang ..... F01D 25/24 415/193
6,508,621 B1 * 1/2003 Zeighami ..... F04D 25/166 415/119
6,663,342 B2 * 12/2003 Huang ..... F04D 29/542 415/121.2
7,429,162 B2 * 9/2008 Lee ..... F04D 25/0613 415/211.2
8,727,235 B2 * 5/2014 Nunes ..... A01K 13/00 239/381
10,100,836 B2 * 10/2018 Stickney ..... F04D 25/08
2008/0277126 A1 * 11/2008 Lindgren ..... A62C 3/04 169/91
2008/0308261 A1 * 12/2008 Aschermann ..... F04D 29/542 165/121
2009/0155104 A1 * 6/2009 Takeshita ..... F04D 19/007 417/423.5
2009/0226299 A1 * 9/2009 Jin ..... F04D 19/007 415/66
2011/0052433 A1 * 3/2011 Huang ..... F04D 19/007 417/423.5
2012/0257957 A1 * 10/2012 Yanagisawa ..... F04D 19/007 415/61
2013/0028715 A1 * 1/2013 Mohammed ..... F04D 29/563 415/150
2013/0121807 A1 * 5/2013 Micheli ..... F04D 19/028 415/58.7
2014/0102676 A1 * 4/2014 Tadokoro ..... F04D 17/04 165/121
2014/0306024 A1 * 10/2014 Fuller ..... B05B 17/08 239/17
2015/0147160 A1 * 5/2015 Crawford ..... F04D 29/545 415/121.2
2015/0260054 A1 * 9/2015 Blake ..... F01D 17/162 60/805
2016/0195097 A1 * 7/2016 Patrick ..... F04D 19/007 415/124.2
2016/0281739 A1 * 9/2016 Nakagawa ..... F04D 29/544
2018/0100407 A1 * 4/2018 Leopold ..... F01D 17/00

* cited by examiner

FIRE-FIGHT VENTILATOR WITH OVALISED AIR JET

CROSS REFERENCE TO RELATED APPLICATIONS

This application is the U.S. National Stage of International Application Number PCT/FR2016/050535 filed on Mar. 9, 2016, which application claims priority under 35 USC § 119 to French Patent Application No. 1552041 filed on Mar. 12, 2015. Both applications are hereby incorporated by reference in their entirety.

TECHNICAL FIELD

The present invention relates to the field of fire fighting blowers.

STATE OF THE ART

Generally, when a building is on fire, the firefighter intervention procedure consists initially in creating an access into the building, for example by opening a door, and then forming an exhaust hole for the fumes to the outside, for example by breaking a window pane.

A fire fighting blower is placed outside the building so as to project a jet of air through the door in order to push the hot fumes outwardly of the building, here through the exhaust hole formed in the window.

The first objective of this procedure is to avoid the "flash-over" phenomenon which occurs when the fumes at 800° C. ignite suddenly. The second objective of the procedure is to increase the visibility in the building in order to facilitate and accelerate the intervention of the firefighters.

Usually, this type of blower, such as the blower 1 shown in FIGS. 1*a* and 1*b*, comprises a propeller 2 and a tubular casing 3 for canalizing and axially guiding the truncated-cone airflow generated by said casing. Such a blower is disclosed in Patent FR2890569.

The blower 1 may also include jet rectifying deflectors 4, as can be seen in FIGS. 1*a* and 1*b*, which are capable of rectifying the air produced by the propeller 2 and concentrating it towards the access door 6 of a building filled with smoke, as can be seen in FIGS. 2*a* and 2*b*.

Document DE 102011013015 discloses a fire fighting blower having an asymmetric air jet.

SUMMARY OF THE INVENTION

The object of the invention is to provide a fire fighting blower whose performance is increased in order to quickly evacuate the hot fumes from the building while generating a wide space in front of the building on fire so as to facilitate and accelerate the firefighter intervention.

To this end, the invention relates to a fire fighting blower comprising a propeller coaxially mounted in a tubular casing for producing an axial airflow, and an airflow guiding device for obtaining a concentrated air jet having a substantially ovalized section, characterized in that it comprises within the tubular casing an assembly of first deflectors for concentrating the axial airflow and generating a concentrated axial air jet and an assembly of second deflectors, including a first right deflector which directs a portion of the airflow in the direction of rotation of the propeller and a second direction reversing deflector, angularly spaced from and upstream of the first right deflector in the direction of rotation of the propeller, which directs this part of the airflow in the opposite direction of rotation of the propeller for generating an air stream deflected from the concentrated axial air jet so that the concentrated air jet having an ovalized section is a combination of the concentrated axial air jet and the deflected air stream.

The blower according to the invention can have the following features:

- the right deflector and the direction reversing deflector are spaced angularly from one another by an angle between 90° and 180°, preferably of 130°;
- the right deflector extends vertically in the casing;
- the direction reversing deflector has a V- or C-shaped cross-section;
- the direction reversing deflector comprises an airflow reception ramp inclined with respect to the axis of the propeller;
- the right deflector and the direction reversing deflector for the airflow are paddle-shaped and extend radially from the axis of rotation of the propeller and the tubular casing.

The ovalized-section air jet 8, shown in FIGS. 3*a* and 3*b*, is meant to come into contact with the entire surface of the door 6 (which is substantially rectangular), the air jet being sufficiently strong for removing the fumes.

In fact, understandably, a conventional blower, such as a blower 1 shown in FIGS. 2*a* and 2*b*, generates on the surface of the door free spaces 7 which are not subjected to the air jet. In practice, the firefighters orientate the truncated-cone air jet generated by the blower 1 towards the top, the middle or the bottom of the door as required. The air pressure difference between the inside and the outside of the building may cause a backflow of a part of the air jet through the free spaces. It occurs that hot fumes escape through these free spaces and can reach the feet or heads of the firefighters.

The ovalized shape of the air jet according to the invention thus makes it possible to cover the entire surface of the door, so that the phenomena of air backflow generated by the blower can be avoided. Thus, a better expulsion of the fumes from the building is obtained in a shorter time due to the higher performance of the blower.

With this arrangement, the blower according to the invention allows to generate an asymmetric air jet relative to the axis of rotation of the propeller. Conventional jet rectifying deflectors can be provided to rectify and concentrate the airflow used to generate the truncated-cone axial air jet. These jet rectifying deflectors have preferably a circular arc cross section which is well adapted for an axial propeller, i.e. whose axis of rotation is collinear with the airflow. The orientation of the jet rectifying deflectors can be adjusted in order to modify and/or optimize the airflow.

In another particular embodiment of the blower according to the invention, the airflow guiding device comprises coaxial concentric tubes which extend axially with respect to the axis of rotation of the propeller and between which the assembly of first deflectors and the assembly of second deflectors are arranged. The assembly of second deflectors and the concentric tubes form a protection grid at the outlet of the tubular casing of the blower and improve the generation of the ovalized air jet. The protection grid can be removably mounted on the tubular casing of the blower or can be provided so as to be interchangeable in order to change the size of the ovalized section of the air jet. The fixing means for the grid on the tubular casing of the blower can be a locking system for example for locking into the tubular casing.

The blower according to the invention is described in greater detail hereinafter and illustrated by the drawings.

This description is given only as an indicative and non-limiting example of the invention.

BRIEF DESCRIPTION OF THE DRAWINGS

The invention will be better understood and other advantages will become apparent from the detailed description of the embodiments given as non-limiting examples and shown in the accompanying drawings, wherein.

DESCRIPTION OF EMBODIMENTS

FIGS. 1, 2*a*-2*b* and 3*a*-3*b* have already been presented in the introduction.

Figure 4:
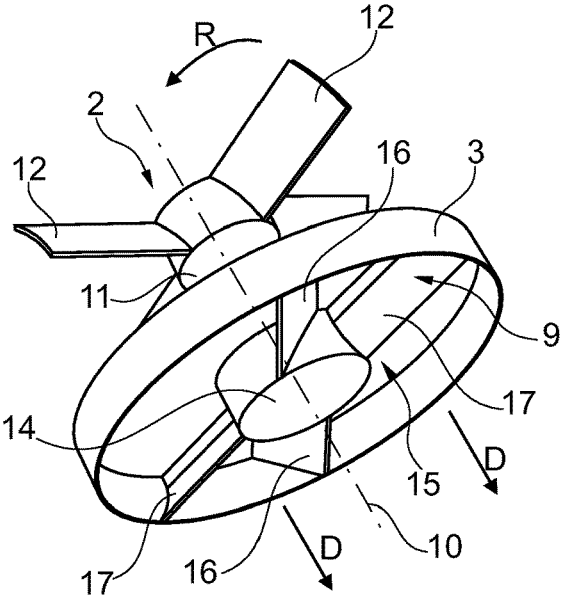
FIG. 4 schematically illustrates a perspective view of right deflectors and direction reversing deflectors in a blower according to the invention.

FIG. 4 illustrates the first embodiment of the blower according to the invention. For reasons of clarity, the blower is schematically represented here with a propeller 2, a guiding device 9 located downstream of the propeller and a tubular casing 3 represented here only around the guiding device 9.

It will be understood that the tubular casing 3 extends upstream of the guiding device 9 around the propeller 2 or even downstream thereof. The blower is arranged here to generate an air jet having an ovalized section in the direction D.

As can be seen in FIG. 4, the propeller rotates about a cylindrical central hub 11 of axis 10 at the periphery of which a plurality of blades 12 extending radially with respect to the axis 10 are evenly distributed.

The tubular casing 3 is here generally cylindrical and is mounted coaxially to the axis 10. This tubular casing 3 is meant to guide, and limit, the swirling air generated by the propeller 2. Without limiting the scope of the invention, the tubular casing 3 can have a cylindrical shaped, a truncated-cone shaped or even a combination of both.

The guiding device 9 for the airflow of the blower comprises a first deflector, here jet rectifying deflectors of conventional type arranged in a grid which closes the tubular casing 3, as can be seen in FIGS. 1*b*, 5*a* to 5*c*. These rectifying deflectors 4 are presented here in the form of paddles which extend radially from a central disc 14 for concentrating the axial air jet having a circular-section truncated-cone shape, generated by the propeller. Here, the diameter of the disc 14 is substantially equal to that of the central hub of the propeller, as can be seen in FIG. 4.

Figure 1A:
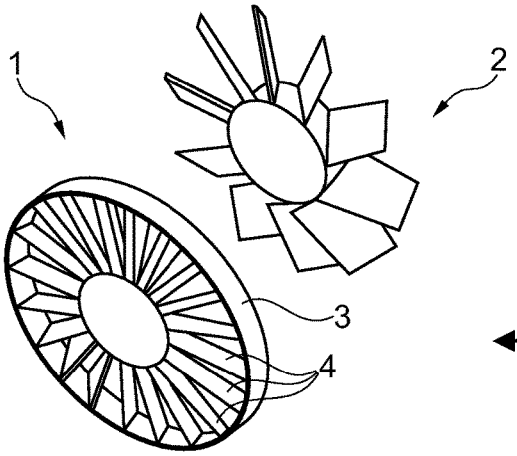
FIG. 1*a* schematically illustrates a conventional fire fighting blower comprising a propeller, a tubular casing and air jet rectifying deflectors.
Figure 1B:
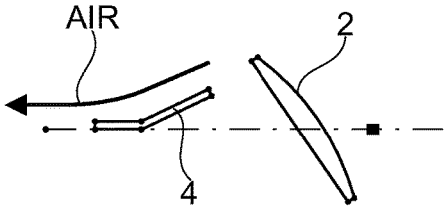
FIG. 1*b* schematically illustrates a section of the blower 1*a;*
Figure 2A:
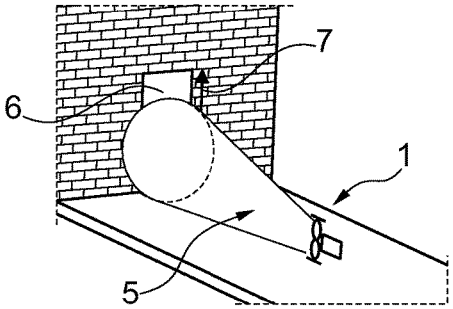
FIGS. 2*a* and 2*b* schematically illustrate a truncated-cone air jet generated by the blower in FIG. 1*a* in front of an access door of a building.
Figure 2B:
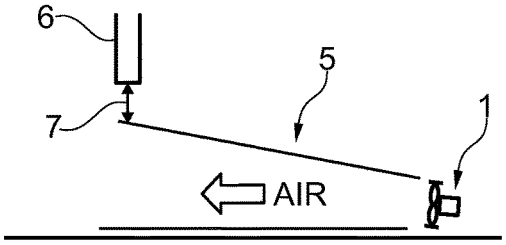
Figure 3A:
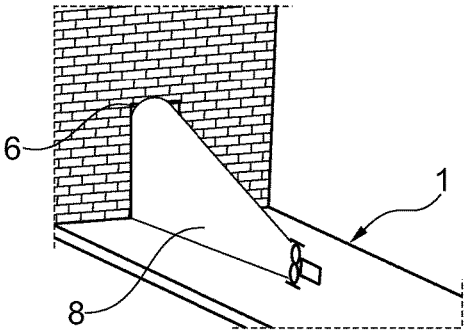
FIGS. 3*a* and 3*b* schematically illustrate an ovalized air jet generated by a blower according to the invention.
Figure 3B:
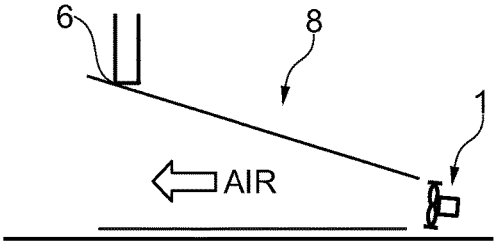

The ability of the jet rectifying deflectors 4 to concentrate the air is due to the fact of having an inclined section over their entire length, as can be seen in FIG. 1*b*.

The guiding device 9 according to the invention further comprises another assembly of deflectors 15 arranged to generate an airflow deflected with respect to the circular-section air jet generated by the jet rectifying deflector 4.

Deflected air stream means a part of the airflow generated by the propeller that is out-of-line relative to the axis of the propeller, irrespective of the axial air jet.

According to the profile and the positioning of the assembly 15 of deflectors, the deflection of the air stream will have a greater or lesser angle of inclination with respect to the axis of the propeller.

The consequence of combining the axial air jet and the deflected air stream is an air jet having a generally ovalized section and an asymmetrical shape with respect to the axis 10 of the propeller.

This combination is carried out here by superposing the axial air jet and the deflected air stream in the manner of a more or less important overlapping. Without limiting the scope of the invention, the combination can also be carried out by juxtaposing the axial air jet and the deflected air stream, or even by slightly spacing them from one another so long as a generally ovalized effect of the air jet is obtained.

To achieve the deflection of the air stream, the assembly 15 of deflectors includes here a right deflector 16 and a direction reversing deflector 17 illustrated in FIGS. 4, 5*a* to 5*c*. The right deflector 16 and the direction reversing deflector 17 are each arranged to direct the airflow into a common part of the casing 3 of the blower. In particular, the right deflector 16 directs a part of the airflow in the direction of rotation R of the propeller 2 and the direction reversing deflector 17 directs this part of the airflow in the opposite direction. The airflows generated come into conflict in the common part of the casing 3 and fuse to produce the deflected air stream.

Figure 5A:
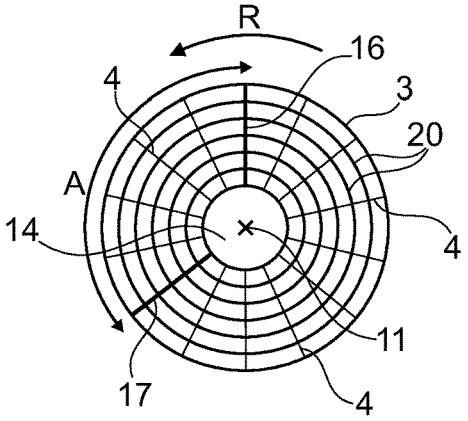
FIGS. 5*a* to 5*c* schematically illustrate the positioning of the right deflectors and direction reversing deflectors in the tubular casing of the blower according to the invention.
Figure 5B:
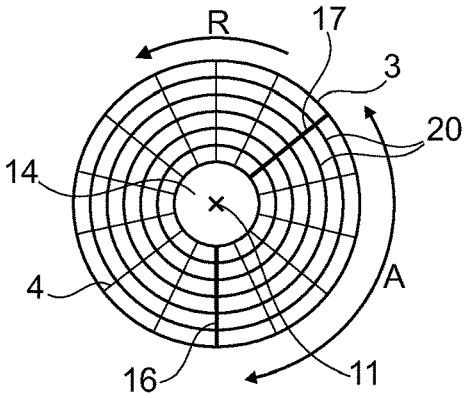
Figure 5C:
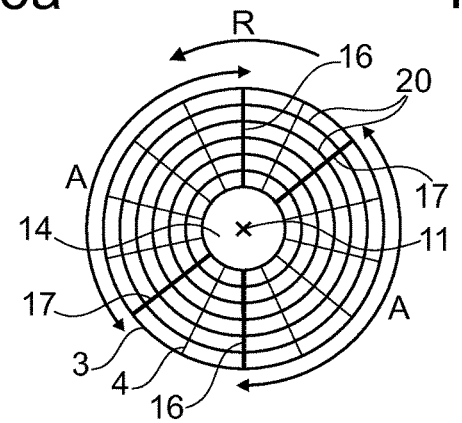

For an optimum efficiency, the direction reversing deflector 17 is here angularly spaced from the right deflector 16 with respect to central disk 14 at an angle A between 90° and 180° and the right deflector is located upstream of the direction reversing deflector in the direction of rotation of the propeller, as can be seen in FIGS. 5*a* to 5*c*.

An angular difference greater than 180° or less than 90° still allows the generation of a deflected air stream but with a decreased power. It has been found that an angular difference of 130° is the optimal difference for generating a deflected air stream with a power close to the power of the axial air jet.

It is therefore understood that the angular difference between the right deflector 16 and the direction reversing deflector 17 in the tubular casing 3 can be adjustable in order to modify the deflection of the air stream and the power thereof.

For combining the deflected air stream and the axial air jet, the right deflector 16 is positioned vertically in the tubular casing, here vertically to the central disc 14.

For an air stream above the axial air jet, the right deflector 16 is placed vertically above the disc 14, as can be seen in FIG. 5*a*. However, for a deflected air stream below the generated axial air jet, the right deflector 16 is placed vertically below the central disc 14, as can be seen in FIG. 5*b*.

Without limiting the scope of the invention, a plurality of right deflectors 16 and direction reversing deflectors 17 can be provided in the tubular casing in accordance with the angular spacing between 90° and 180°, as can be seen in FIGS. 4 and 5*c*.

According to a first embodiment, the right deflectors 16 and direction reversing deflectors 17 each have the form of a paddle extending radially from the central disc 14 to the tubular casing 3. These deflectors 16 and 17 have a generally rectangular shape whose widthwise edges are in contact with the central disc 14 and the tubular casing 3, as can be seen in FIG. 4.

Figure 6:
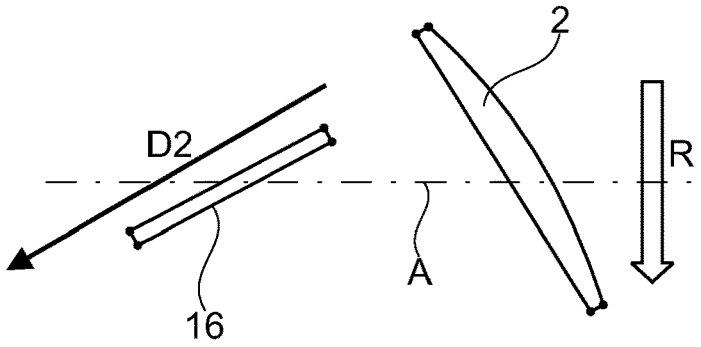
FIG. 6 schematically illustrates a section of the right deflector including the propeller of the blower according to the invention.

The right deflector 16 has here the shape of a plate inclined lengthwise and in the direction of rotation R of the propeller, as can be seen in FIGS. 4 and 6, for guiding the air in the direction D2. The inclination of the right deflector 16 can also be changed according to the inclination of the blades so as to limit airflow losses generated by the propeller 2.

Figure 7A:
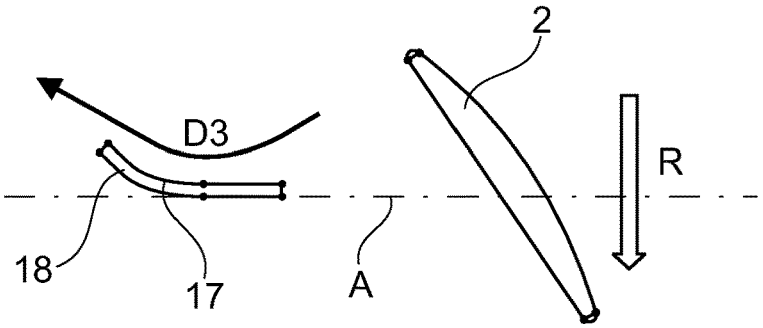
FIGS. 7*a* and 7*b* schematically illustrate the airflow direction reversing deflector including the propeller of the blower according to two alternative embodiments of the invention.
Figure 7B:
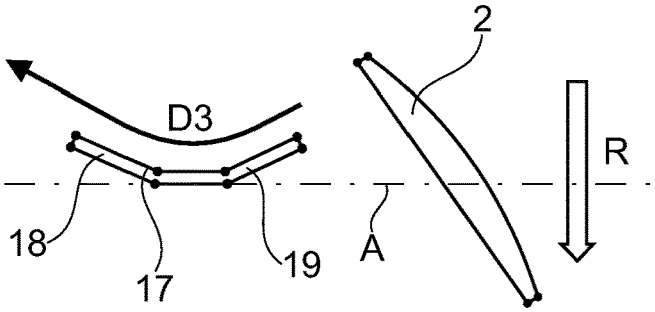

In this embodiment, the direction reversing deflector 17 has a V- or C-shaped cross-section. The direction reversing deflector is a kind of gutter inclined in the opposite direction of rotation of the propeller, as can be seen in FIGS. 4, 7*a* and 7*b*. A part of the gutter has the shape of a guiding ramp 18 for guiding the air generated by the propeller in a direction D3, as can be seen in FIGS. 4, 7*a* and 7*b*.

It will be understood that the inclination of the right deflector 16 and the guiding ramp 18 is used to define the location of the part of the casing 3 in which the conflict of the air jet with the air stream takes place.

According to an alternative embodiment, the gutter of the direction reversing deflector 17 comprises a reception ramp 19 placed upstream of the guiding ramp 18 with respect to the propeller 2, in order to receive the airflow generated by the propeller of the blower, as can be seen in FIG. 7B.

It is understood that, with such an arrangement according to the invention, the airflow generated by the rotation of the propeller is first received onto the reception ramp 19 and then moves towards the guiding rail 18.

According to another alternative to this first embodiment of the invention, the blower comprises juxtaposed concentric tubes 20 which are coaxial to the axis 11 of the propeller and arranged to be fixed in the casing 3, as can be seen in FIGS. 5*a* to 5*c*. Here, the concentric tubes extend axially with respect to the axis A of rotation of the propeller 2. The paddles 4 of the jet rectifying deflectors as well as the right deflector 16 and direction reversing deflector 17 extend through concentric tubes from the disc 14 to the tubular casing 3, as can be seen in FIGS. 5*a* to 5*c*. These concentric tubes thus improve the performance of the blower 1 when they are coupled with the guiding device 9.

Figure 8:
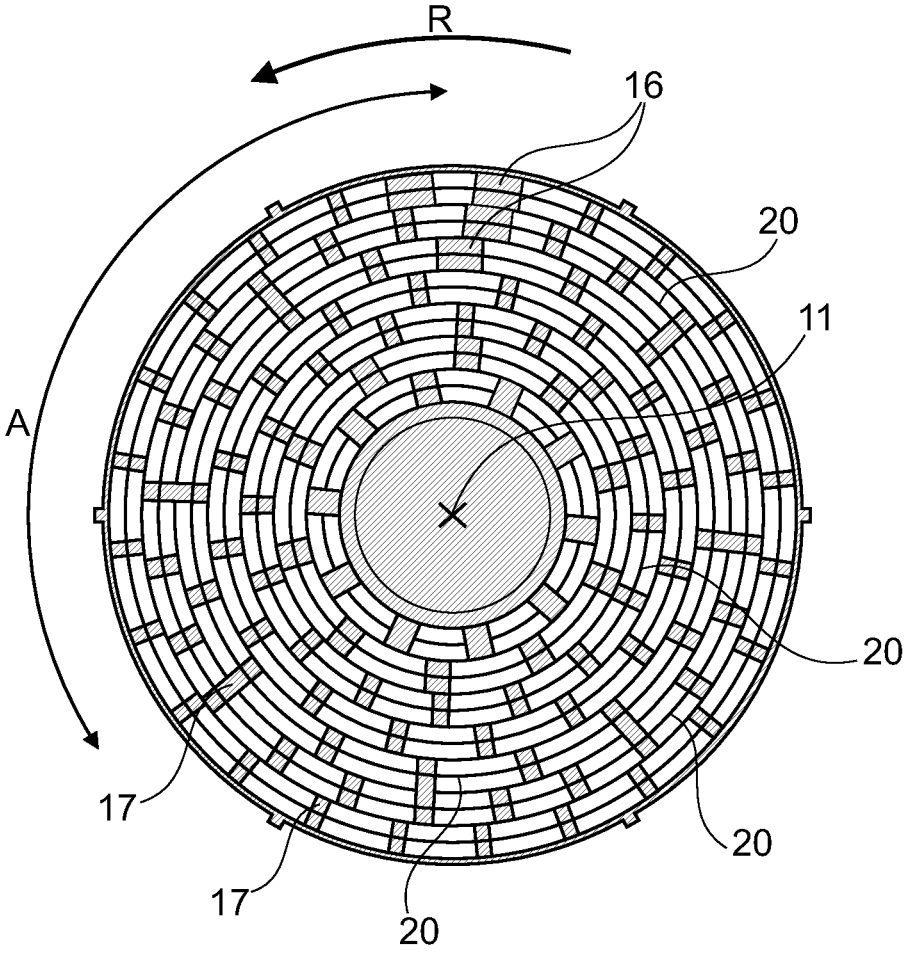
FIG. 8 schematically illustrates the right deflector and the direction reversing deflector forming section wires in concentric tubes.

According to a second embodiment of the invention shown in FIG. 8, the right deflectors 16 and direction reversing deflectors 17 form "section wires" with the concentric tubes 20, as can be seen in FIG. 8. Section wire means that only two concentric adjacent tubes 20 can be connected to each other by a right deflector and a direction inverter deflector.

The right deflector 16 and direction reversing deflector 17, which form the section wires, keep their shape and function but in order to generate a targeted and limited deflected air stream so as to optimize the performance of the blower 1.

In this second embodiment, the angular deviations A between the right deflector 16 and the direction reversing deflector 17 are also between 90° and 180°.

Depending on requirements, several section wires can be placed near the tubular casing 3, near the central disk 14 or randomly distributed between the concentric tubes 20.

According to an alternative embodiment of the invention, the blower 1 comprises both an assembly of deflectors 15 in the form of a "section wire" and in the form of paddles which extend from the disc 14 to the tubular casing 3.

Due to their arrangement, it will be understood that the first deflector 4, the assembly 15 of deflectors and the concentric tubes 20 form a protection grid. The protection grid may be removably mounted on the casing of the blower or may be interchangeable in order to change the size of the ovalized section of the air jet. The fixing means for the grid on the tubular casing of the blower can be a locking system for example for locking into the tubular casing.

With the blower according to the invention, one obtains preferably a concentrated airflow having a generally ovalized shape that meets the constraints of the conventional blowers.

The invention claimed is:

1. A fire fighting blower comprising:

a propeller coaxially mounted in a tubular casing for generating an axial airflow, and an airflow guiding device within the tubular casing, wherein said airflow guiding device comprises rectifying deflectors for concentrating said axial airflow generated by the propeller in a concentrated axial air jet, straight deflector which directs a part of said axial airflow in the direction of rotation of said propeller, and a direction reversing deflector curved in a shape of a gutter inclined in a direction opposite the direction of rotation of the propeller, angularly spaced from and upstream of the straight deflector with regard to movement of said propeller, which directs a part of said axial airflow in a direction opposite that of the direction of rotation of said propeller so that both axial flows directed by the straight deflector and the direction reversing reflector fuse to generate an air stream deflected from the concentrated axial air jet, and wherein the combination of said deflected air stream and said concentrated air jet form an air jet having an ovalized section.

2. The blower according to claim 1, wherein said straight deflector and said direction reversing deflector are angularly spaced relative to each other by an angle between 90° and 180°.

3. The blower according to claim 2, wherein said straight deflector and said direction reversing deflector are angularly spaced relative to each other by an angle of 130°.

4. The blower according to claim 3, wherein said direction reversing deflector has a V- or C-shaped cross-section.

5. The blower according to claim 4, wherein said straight deflector and said direction reversing deflector of the airflow have a paddle shape and extend radially between an axis of rotation of said propeller and said tubular casing.

6. The blower according to claim 5, wherein said air flow guiding device further comprises coaxial concentric tubes which extend axially with respect to the axis of rotation of said propeller between the tubular casing and the central disc of the propeller and between which said rectifying deflectors and said straight and direction reversing deflectors are arranged.

7. The blower according to claim 6, wherein said straight deflector extends vertically in said tubular casing.

8. The blower according to claim 6, wherein said straight deflector, said direction reversing deflector and said concentric tubes form a protection grid downstream of said propeller relative to the direction of the airflow.

9. The blower according to claim 2, wherein said direction reversing deflector has a V- or C-shaped cross-section.

10. The blower according to claim 1, wherein said direction reversing deflector has a V- or C-shaped cross-section.

11. The blower according to claim 1, wherein said straight deflector and said direction reversing deflector of the airflow have a paddle shape and extend radially between the axis of rotation of said propeller and said tubular casing.

12. The blower according to claim 1, wherein said airflow guiding device further comprises coaxial concentric tubes which extend axially with respect to an axis of rotation of said propeller between the central disc of the propeller and the tubular casing and between which said rectifying deflectors and said straight and direction reversing deflectors are arranged.

13. The blower according to claim 1, wherein said straight deflector extends vertically in said tubular casing.

14. The blower according to claim 12, wherein said straight deflector, said direction reversing deflector and said concentric tubes form a protection grid downstream of said propeller relative to the direction of the airflow.

* * * * *